US007430983B2

(12) United States Patent
Hicok et al.

(10) Patent No.: US 7,430,983 B2
(45) Date of Patent: Oct. 7, 2008

(54) LOADER BUCKET ORIENTATION INDICATOR

(75) Inventors: Gaylen Eugene Hicok, Charles City, IA (US); Robert James Recker, Waterloo, IA (US); Robert Lee Sterken, New Hartford, IA (US)

(73) Assignee: Deere & Company, Moline, IL (US)

( * ) Notice: Subject to any disclaimer, the term of this patent is extended or adjusted under 35 U.S.C. 154(b) by 282 days.

(21) Appl. No.: 11/087,454

(22) Filed: Mar. 23, 2005

(65) Prior Publication Data

US 2006/0245902 A1 Nov. 2, 2006

(51) Int. Cl.
*G09F 9/00* (2006.01)

(52) U.S. Cl. ..... 116/313; 116/DIG. 13; 37/906

(58) Field of Classification Search ..... 37/348, 37/382, 195, 906; 172/1, 2, 5, 6; 701/50; 414/694, 699; 33/328, 398, 401, 555, 624, 33/792, 795, 797, 798, 801; 116/284, 288, 116/303, 313, 320, DIG. 13
See application file for complete search history.

(56) References Cited

U.S. PATENT DOCUMENTS 2,808,017 A * 10/1957 Killebrew ..... 33/624
2,835,220 A * 5/1958 Rardin ..... 33/370
2,883,077 A * 4/1959 Pilch ..... 414/700
3,011,261 A * 12/1961 Riley ..... 33/1 N
3,017,046 A * 1/1962 Runci et al. ..... 414/698
3,141,563 A * 7/1964 Fisher ..... 414/698
3,198,360 A * 8/1965 Strader et al. ..... 414/701
3,760,922 A * 9/1973 Rolt et al. ..... 192/111 B
3,796,335 A * 3/1974 Smith et al. ..... 414/698
3,800,425 A * 4/1974 Hayine ..... 33/333
3,846,781 A * 11/1974 Smith ..... 116/53
4,211,332 A * 7/1980 Pitman ..... 212/282
4,391,563 A * 7/1983 Vietor ..... 414/698
4,604,025 A * 8/1986 Hammoud ..... 414/698
4,629,982 A * 12/1986 Kieslich ..... 324/207.23
4,994,741 A * 2/1991 Takahashi ..... 324/207.23
5,012,939 A * 5/1991 Pitman et al. ..... 212/282
5,627,467 A * 5/1997 Lee et al. ..... 324/207.22
5,670,886 A * 9/1997 Wolff et al. ..... 324/644
5,719,496 A * 2/1998 Wolf ..... 324/165
6,152,238 A * 11/2000 Ferrell et al. ..... 172/2
6,609,315 B1 * 8/2003 Hendron et al. ..... 37/348
6,763,619 B2 7/2004 Hendron et al. ..... 37/348
7,017,701 B2 * 3/2006 Flynn et al. ..... 180/282

* cited by examiner

*Primary Examiner*—Thomas B Will
*Assistant Examiner*—James L McGowan

(57) ABSTRACT

A loader bucket orientation indicating system is provided for a bucket pivotal at an end of a loader boom. The system includes a support member having a base fixed to a side of an arm of the boom and a shaft projecting from the base. A pivot plate includes a central hub rotatably mounted on the shaft and an arm projecting outwardly from the central hub. An outer end of the arm forming a visible bucket position indicator. A linkage couples the bucket to the pivot plate so that the pivot plate rotates clockwise and counter-clockwise as the bucket rotates clockwise and counter-clockwise, respectively, with respect to the boom. A rotary device has a base fixed with respect to the boom arm, and has a rotary member coupled to the base by a non-rigid coupling. The rotary member has a visible mark thereon. The position of the bucket position indicator relative to the mark provides an indication of bucket orientation.

A weight attached to the rotary member maintains it in a substantially fixed orientation relative to a horizontal plane.

8 Claims, 4 Drawing Sheets

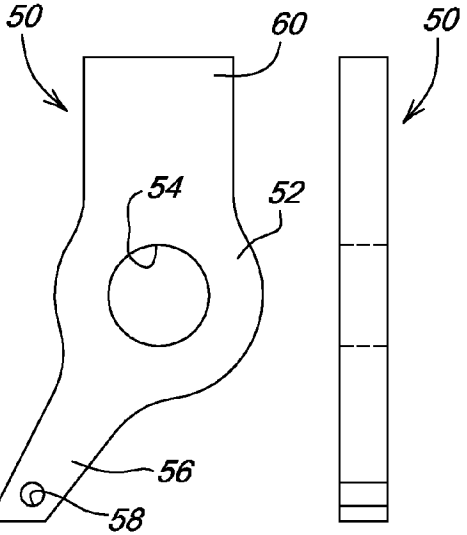
Fig. 6
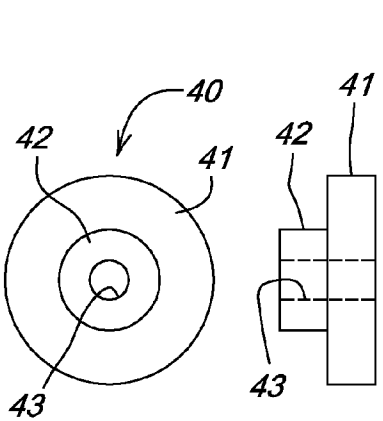
Fig. 5
Fig. 4
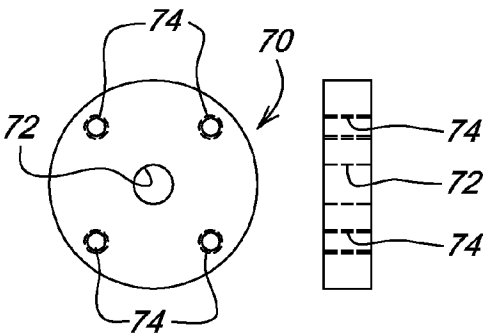
Fig. 3
Fig. 8
Fig. 7
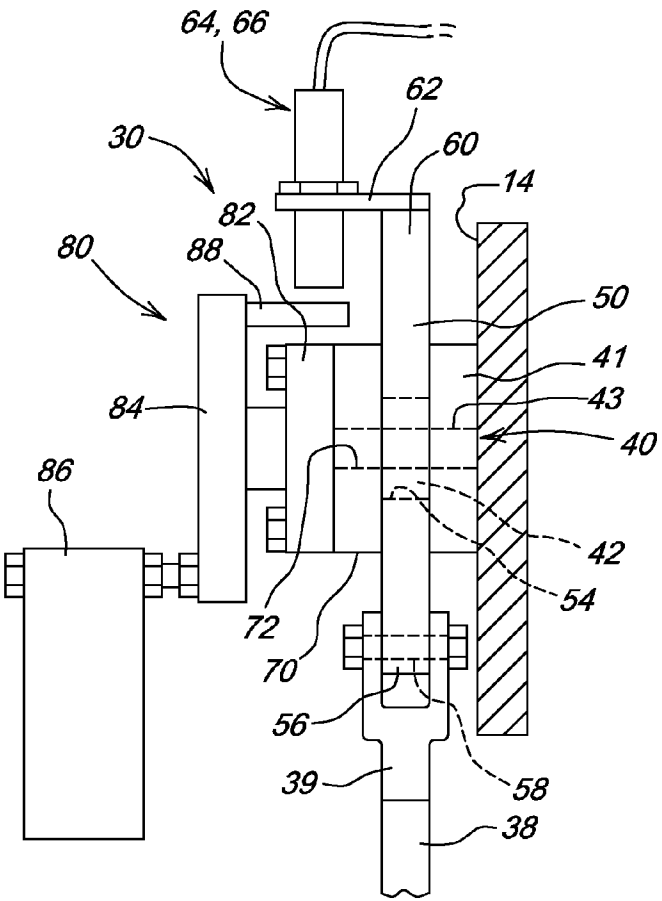
Fig. 2

LOADER BUCKET ORIENTATION INDICATOR

BACKGROUND

The present invention relates to a bucket orientation indicator for mounting on the boom a vehicle-mounted loader assembly.

When operating a loader bucket, it is often desirable to know the orientation of the bucket—whether or not the bucket is level with the ground, or whether or not the bottom surface of the bucket is parallel to the ground. However, this relationship is difficult to determine by an operator positioned in the cab or operator's station of the vehicle.

There exists commercially available bucket level indicators which provide an indication of when the bucket is level when the loader boom is in its down position. However, this level indicator does not provide an accurate indication of bucket orientation when the boom is raised or when the ground is not level. It would be desirable to have a bucket level indicator which provided an indication of the bucket orientation regardless of boom height and regardless of the orientation of the vehicle.

SUMMARY

Accordingly, an object of this invention is to provide a loader bucket orientation indicator which provides an indication of bucket orientation regardless of boom height and regardless of the orientation of the vehicle.

This and other objects are achieved by the present invention, wherein a loader bucket orientation indicating system includes a support member fixed to a side of an arm of the boom, a pivot plate rotatably supported by the support member and having a visible bucket position indicator, a linkage coupled between the bucket and the pivot plate so that the pivot plate rotates as the bucket rotates, and a rotary member rotatably coupled to the support member. The rotary member has a weight attached thereto so that the rotary member maintains a substantially fixed orientation relative to a horizontal plane. The rotary member has a visible mark thereon. The position of the bucket position indicator relative to the mark provides an indication of bucket orientation.

A sensor member projects from the rotary member. A sensor unit is mounted on the pivot plate adjacent to the sensor member. The sensor unit generates signals representing a position of the pivot plate relative to the rotary member. A control circuit controls operation of a bucket cylinder and/or activates lamps in response to signals from the sensor unit.

BRIEF DESCRIPTION OF THE DRAWINGS

FIG. 2 is a detailed partially sectional side view of a portion of the bucket orientation indicating apparatus in the direction of arrows 2-2 of FIG. 1;

FIG. 3 is an end view of a base unit of the present invention;

FIG. 4 is a side view of the base unit of FIG. 3;

FIG. 5 is an end view of a pivot plate of the present invention;

FIG. 6 is a side view of the pivot plate of FIG. 5;

FIG. 7 is an end view of a mounting plate of the present invention;

FIG. 8 is a detailed perspective view of a portion of the present invention;

DETAILED DESCRIPTION

Figure 1:
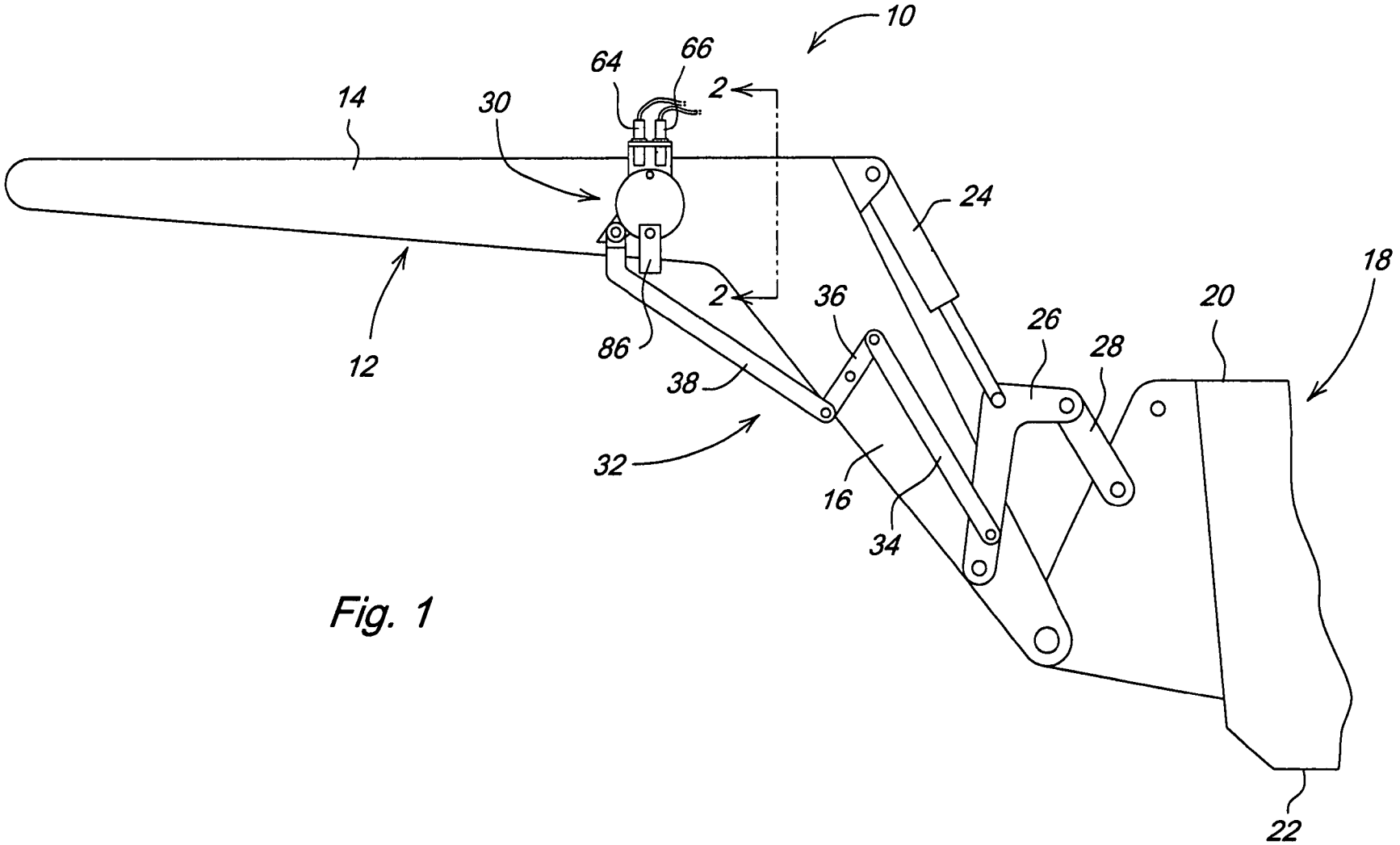
FIG. 1 is a view of a loader frame and bucket mechanism including the bucket orientation indicating apparatus of the present invention.

Referring to FIG. 1, a loader 10 includes a boom 12 which is formed by arms 14 and 16. A bucket 18 is pivotally mounted at the end of arm 16. Preferably, the bucket 18 has parallel top and bottom plates 20, 22. The end of arm 14 is supported on a vehicle (not shown), such as an agricultural tractor. The bucket 18 is pivoted with respect to arm 16 by a conventional double-acting hydraulic piston 24. Piston 24 is coupled to bucket 18 by a pivot arm 26 and a link 28.

According to the present invention, a bucket level indicating device 30 is mounted on the side of the boom 12 so as to be visible to an operator of the vehicle (not shown). A part of device 30 is coupled to pivot arm 26 by a linkage 32. Linkage 32 includes rods 34, pivot link 36 and rod 38. Rod 34 is coupled between pivot arm 26 and pivot link 36. Pivot link 36 is coupled between rod 34 and rod 38. Rod 38 is coupled between pivot link 36 and the indicator device 30.

Referring now to FIG. 2-4, the indicator device 30 includes a base unit 40 which includes a larger diameter base 41 which is attached (such as by bolts—not shown) to the side of boom arm 14. Base unit 40 also includes a smaller diameter shaft 42 which projects axially from the base 41. A threaded bore 43 extends through a central axis of base unit 40.

Figure 9:
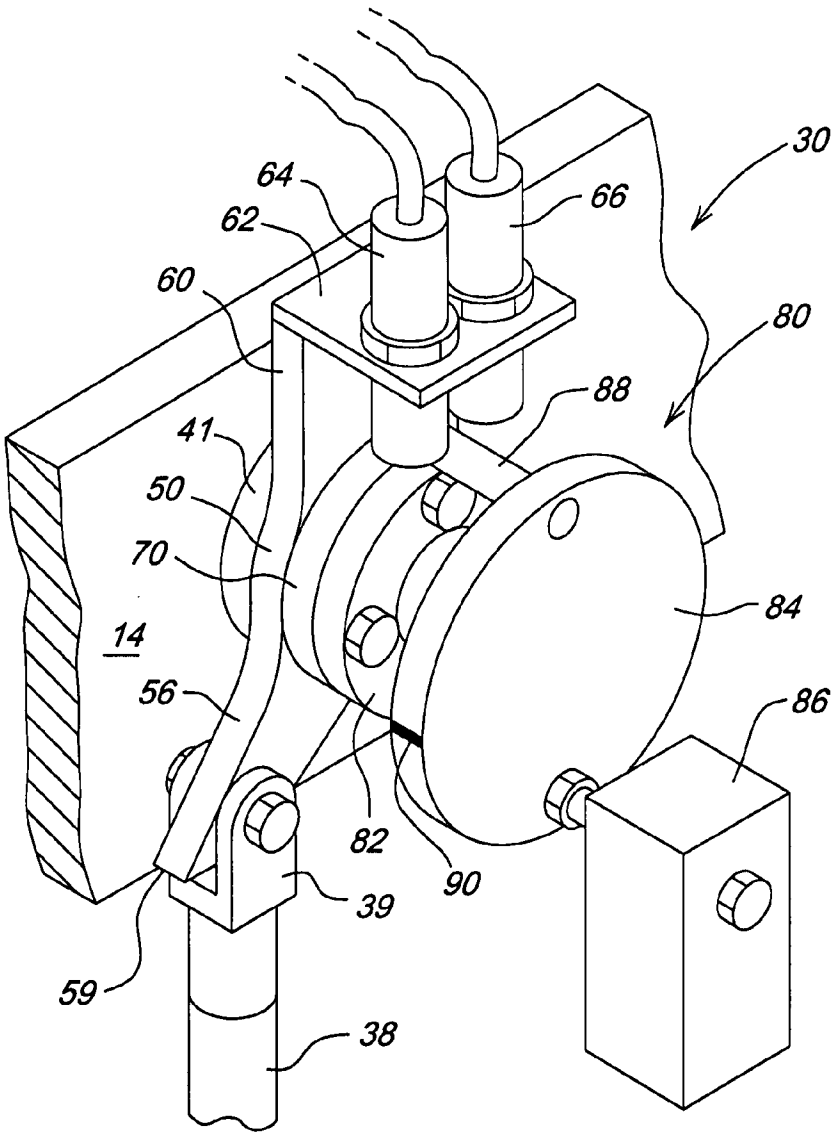
FIG. 9 is a perspective view of the bucket orientation indicating apparatus of FIG. 1.

Referring now to FIGS. 2, 5 and 6, a pivot plate 50 is rotatably mounted on the shaft 42. Pivot plate 50 includes a central hub 52 with bore 54 therethrough which receives shaft 42. A link arm 56 projects from hub 52 and includes a link bore 58 for coupling to a clevis 39 on the end of rod 38. The end of link arm 56 forms a corner or pointer 59. A sensor mounting arm 60 projects away from hub 52. As best seen in FIG. 2, a sensor bracket 62 is attached to an end of arm 60. As best seen in FIGS. 1 and 2, a pair of non-contacting magnetic proximity sensors 64 (up) and 66 (down) are mounted side-by-side on the bracket 62 with their lower sensing ends projected downwardly and generally towards the center of the device 30. As best seen in FIGS. 2, 5 and 9, the pivot plate 50 is a unitary part, and is coupled to the support member 40 only through the shaft 42.

Referring now to FIGS. 2, 7 and 8, a circular mounting plate 70 is fixed to an end of shaft 42, such as by a bolt (not shown) through central bore 72. Plate 70 includes a plurality of mounting holes 74 spaced apart outwardly from the central bore 72. As a result, plate 70 does not rotate with respect to loader arm 14.

A rotary device 80, such as for example, a commercially available viscous fan drive, is attached to plate 70. Rotary device 80 includes a base 82 which is attached (such as by bolts) to the plate 70, and rotary member 84 which is rotatable with respect to the hub 82 and which is coupled to the hub by a non-rigid coupling, such as a viscous fluid coupling. A weight 86 is pivotally coupled to and hangs from the rotary member 84 so that rotary member 84 will remain in a fixed orientation with respect to the ground as the boom 12 is pivoted up and down. As best seen in FIGS. 2 and 8 a sensor pin 88 projects axially from a radially outer portion of the rotary member 84 and towards the mounting arm 60. The pin 88 preferably extends to a position slightly below the bottom ends of the sensors 64, 66. Thus, as the sensors 64, 66 rotate clockwise and counter-clockwise above the pin 88 as the pivot plate is rotated by the linkage 32, the pin 88 actuates the up sensor 64 and the down sensor 66.

Referring now to FIG. 9, the weight 86 maintains the orientation of the rotary member 84 with respect to the ground. A visible mark 90 is placed on an outer edge of the rotary member 84 at a position on a horizontal plane which passes through the center of rotary member 84. As seen in FIG. 9, the pointer 59 and the mark 90 are visible to an operator in a vehicle operator's station (not shown). The position of the pointer 59 relative to mark 90 indicates the orientation of the bucket relative to the ground.

Figure 10:
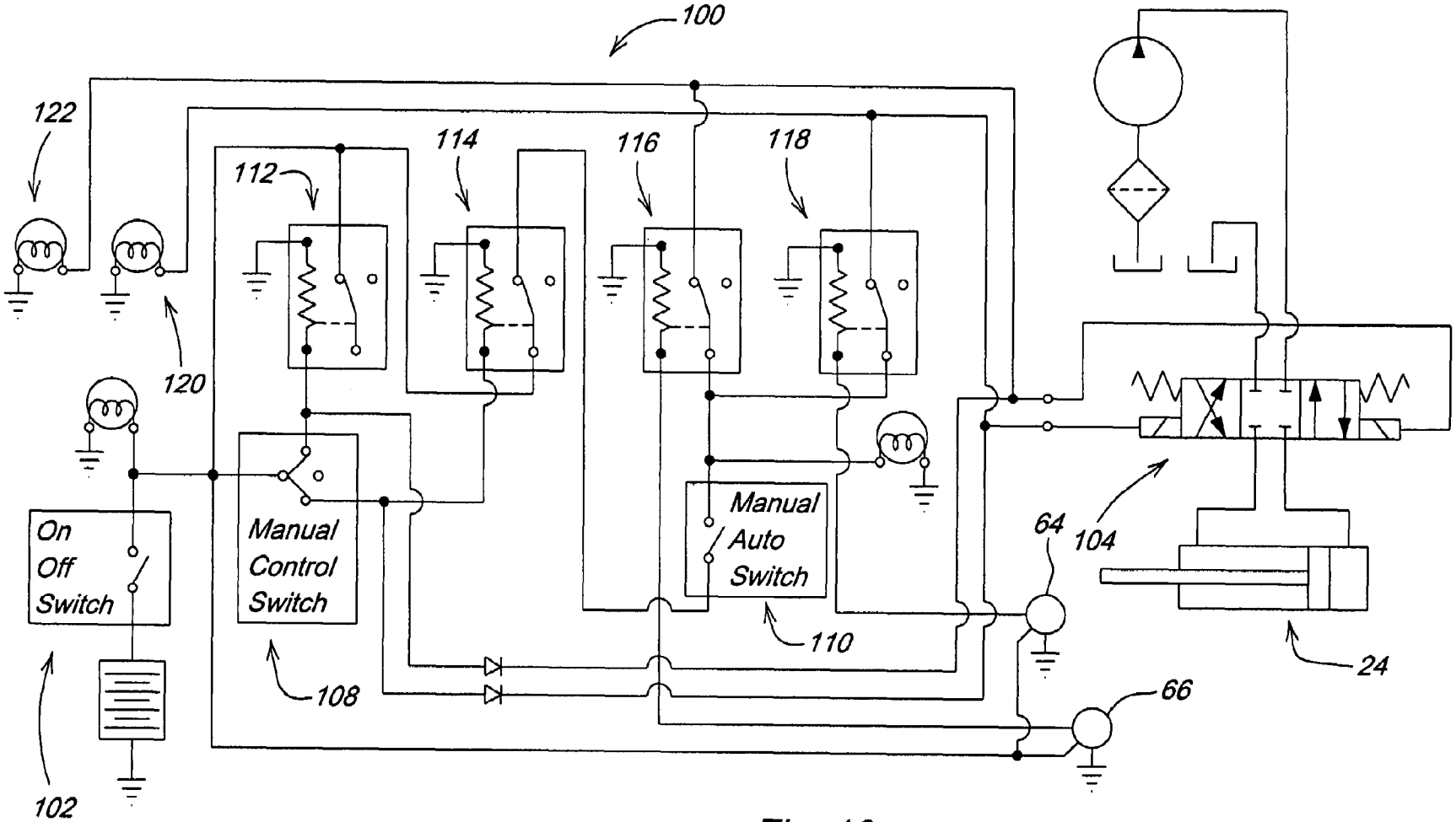
FIG. 10 is a schematic diagram of a control circuit for use with the present invention.

Referring now to FIG. 10, a relay control circuit 100 is connected to the up sensor 64 and down sensor 66, to an on-off switch 102, and to the solenoids of a conventional bucket raise/lower electro-hydraulic valve 104. Circuit 100 includes a manual control switch 108, an auto/manual select switch 110 and relays 112-118. Circuit 100 is also connected to an up indicator lamp 120 and a down indicator lamp 122 which may be located in a vehicle operator's cab (not shown). When switch 102 is on, the control circuit 100 operates to activate valve 104 and raise the bucket when sensor 64 is activated by sensor arm 88, and operates to activate valve 104 and lower the bucket when sensor 66 is activated by sensor pin 88.

The circuit 100 can be configured to only activate lamps 120, 122, or to only activate the electro-hydraulic valve 104, or it can be configured to activate both lamps 120, 122 and the electro-hydraulic valves 104.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A loader bucket orientation indicating system for a loader boom assembly having a bucket pivotally mounted on an end of a boom, the bucket orientation indicating system comprising:

a support member comprising a base non-rotatably fixed to a side of an arm of the boom and a shaft projecting from the base;

a pivot plate rotatably mounted on the shaft and having a visible bucket position indicator;

a linkage coupled between the bucket and the pivot plate so that the pivot plate rotates clockwise and counter-clockwise as the bucket rotates clockwise and counter-clockwise, respectively, with respect to the boom, the linkage comprising a plurality of rigid links pivotally coupled together;

a mounting plate fixed to an end of the support member and non-rotatable with respect to the boom; and a rotary member which is rotatably coupled to the mounting plate, the rotary member having a weight attached thereto so that the rotary member maintains a substantially fixed orientation relative to a horizontal plane, and the rotary member having a visible mark thereon, the position of the bucket position indicator relative to the mark providing an indication of bucket orientation relative to the horizontal plane.

2. A loader bucket orientation indicating system for a loader boom assembly having a bucket pivotally mounted on an end of a boom, the bucket orientation indicating system comprising:

a support member comprising a base non-rotatably fixed to a side of an arm of the boom and a shaft projecting from the base;

a unitary pivot plate rotatably mounted on the shaft and having a visible bucket position indicator, the pivot plate being coupled to the support member only through the shaft;

a linkage coupled between the bucket and the pivot plate so that the pivot plate rotates clockwise and counter-clockwise as the bucket rotates clockwise and counter-clockwise, respectively, with respect to the boom, the linkage comprising a plurality of rigid links pivotally coupled together;

a mounting plate fixed to an end of the support member and non-rotatable with respect to the boom; and a rotary member which is rotatably coupled to the mounting plate, the rotary member having a weight attached thereto so that the rotary member maintains a substantially fixed orientation relative to a horizontal plane, and the rotary member having a visible mark thereon, the position of the bucket position indicator relative to the mark providing an indication of bucket orientation relative to the horizontal plane.

3. The loader bucket orientation indicating system of claim 2, wherein:

the pivot plate comprises a central hub and the bucket position indicator comprises an arm projecting outwardly from the central hub.

4. The loader bucket orientation indicating system of claim 2, wherein:

the rotary member is coupled to the mounting plate by a viscous fluid coupling.

5. The loader bucket orientation indicating system of claim 2, further comprising:

a sensor member projecting from the rotary member; and a sensor unit adjacent the sensor member and mounted on the pivot plate, the sensor unit generating signals representing a position of the pivot plate relative to the rotary member.

6. The loader bucket orientation indicating system of claim 5, wherein:

the sensor unit comprises a pair of magnetic proximity sensors.

7. The loader bucket orientation indicating system of claim 2, further comprising:

a sensor system generating signals in response to movement of the pivot plate; and a control circuit for controlling operation of a bucket cylinder in response to signals from the sensor system.

8. The loader bucket orientation indicating system of claim 2, further comprising:

a sensor system generating signals in response to movement of the pivot plate; and a control circuit for controlling activation of indicator lamps in response to signals from the sensor system.

* * * * *